United States Patent [19]

Hesterberg et al.

[11] Patent Number: 4,821,694

[45] **Date of Patent: * Apr. 18, 1989**

[54] HYPEREUTECTIC ALUMINUM-SILICON CASTING ALLOY

[75] Inventors: William G. Hesterberg; Raymond J. Donahue; Benjamin L. Sheaffer, all of Fond du Lac, Wis.

[73] Assignee: Brunswick Corporation, Skokie, Ill.

[ * ] Notice: The portion of the term of this patent subsequent to Aug. 5, 2003 has been disclaimed.

[21] Appl. No.: 867,401

[22] Filed: May 13, 1986

Related U.S. Application Data

[63] Continuation of Ser. No. 723,058, Apr. 15, 1985, Pat. No. 4,603,665.

[51] Int. Cl.[4] ..... C22C 21/02; F02F 7/00

[52] U.S. Cl. ..... 123/195 R; 164/47; 164/137; 420/534; 420/546

[58] Field of Search ..... 164/47, 137; 420/546, 420/534, 549, 550, 547; 123/195 R

[56] References Cited

U.S. PATENT DOCUMENTS

| | | | |
|---|---|---|---|
| 1,947,121 | 6/1937 | Bonsack | 75/1 |
| 2,357,452 | 9/1944 | Bonsack | 75/141 |
| 3,092,744 | 6/1963 | Stonebrook | 310/211 |
| 3,726,672 | 4/1973 | Lindberg et al. | 75/142 |
| 3,881,879 | 5/1975 | Singleton et al. | 29/193 |
| 4,297,976 | 11/1981 | Bruni | 123/193 |

FOREIGN PATENT DOCUMENTS

| | | |
|---|---|---|
| 54-39311 | 3/1979 | Japan . |
| 1437144 | 5/1976 | United Kingdom . |

OTHER PUBLICATIONS

Alloy Digest, Reynolds 390 & A390, Aug. 1971.
Alloy Digest, Aluminum 392.0, Sep. 1970.
Ward's Engine Update, May 15, 1982, "Top Engine Designers Laud Sleeveless Alloy Use", (pp. 4,5).
Engineering Control for High Volume 390 Die Casting, Ward, N. L. Industries Inc., pp. 57–61.
Aluminum Alloy with High Silicon Content, Stonebrook.

*Primary Examiner*—Kuang Y. Lin
*Attorney, Agent, or Firm*—Andrus, Sceales, Starke & Sawall

[57] ABSTRACT

A hypereutectic aluminum-silicon casting alloy having particular use in casting cylinder blocks for marine engines. The alloy is composed by weight of 16% to 19% of silicon, 0.4 to 0.7% magnesium, up to 0.37% copper and the balance aluminum. With the stated silicon content the alloy has good fluidity and the precipitated silicon crystals provide excellent wear resistance. In addition, the alloy has a narrow solidification range of less than 150° F., thereby providing the alloy with excellent castability. The copper content is maintained at a minimum so that the alloy has improved resistance to salt water corrosion.

7 Claims, No Drawings

HYPEREUTECTIC ALUMINUM-SILICON CASTING ALLOY

This is a continuation of application Ser. No. 723,058, filed Apr. 15, 1985, now U.S. Pat. No. 4,603,665.

BACKGROUND OF THE INVENTION

In the past, aluminum alloys, due to their light weight, have been used for engine blocks for internal combustion engines. In order to provide the necessary wear resistance for the cylinder bores, it has been customary to chromium plate the cylinder bores, or alternately, to apply cast iron liners to the bores. It is difficult to uniformly plate the bores and as a result plating is an expensive operation. The use of cast iron liners increases the overall cost of the engine block as well as the weight of the engine.

Hypereutectic aluminum silicon alloys containing 17% to 19% by weight of silicon possess good wear resistant properties achieved by the precipitated silicon crystals, which constitute the primary phase. Because of the wear resistant properties, attempts have been made to utilize hypereutectic aluminum-silicon alloys as casting alloys for engine blocks to eliminate the need of plated or lined cylinder bores.

It has been found that as the silicon content in an aluminum-silicon-copper alloy is increased to the range of 17% to 19%, the castability of the ternary alloy is adversely effected. As an example, a common hypereutectic aluminum-silicon-copper alloy containing 16% to 18% silicon, 0.6% to 1.1% iron, 4.0% to 5.0% copper, 0.1% manganese, and 0.45% to 0.65% magnesium and balance aluminum, has good wear resistance, as well as a desirable low fraction solids at the eutectic temperature, thereby providing good fluidity. However, this alloy has a wide solidification temperature range, in the neighborhood of 250°, which severely detracts from its castability. Further, the alloy contains a substantial amount of copper which reduces the corrosion resistance of the alloy in salt water environments and thus prevents its use for marine engines.

Another commonly used hypereutectic aluminum silicon alloy has a nominal composition of 19% silicon, 0.6% copper, 1% magnesium and 0.4% manganese with the balance aluminum. Again, this alloy has good wear resistance due to the precipitated silicon crystals, but has relatively poor corrosion resistance when subjected to salt water environments.

SUMMARY OF THE INVENTION

The invention is directed to an improved hypereutectic aluminum silicon casting alloy which has use in casting engine blocks for marine engines.

The alloy of the invention contains by weight from 16% to 19% silicon, up to 1.4% iron, 0.4% to 0.7% magnesium, up to 0.3% manganese up to 0.37% copper and the balance aluminum. The copper content is preferably maintained as low as possible, and below 0.37%.

Due to the precipitated silicon crystals, the alloy has excellent wear resistance.

As the copper content is maintained at a minimum, the alloy has greatly improved resistance to salt water corrosion, so that it is particularly useful for casting blocks for marine engines.

By minimizing the copper content, the ternary aluminum-silicon-copper eutectic is avoided and thus, quite unexpectedly, provides a relatively narrow solidification range, below 150° F. and preferably 100° F. These properties provide substantially improved castability over ternary hypereutectic aluminum silicon alloys.

Other objects and advantages will appear in the course of the following description.

DESCRIPTION OF THE PREFERRED EMBODIMENT

The hypereutectic aluminum silicon casting alloy of the invention has the following general composition in weight percent:

Silicon: 16–19%
Magnesium: 0.4–0.7%
Iron: Up to 1.4%
Manganese: Up to 0.3%
Copper: Up to 0.37%
Aluminum: balance.

The magnesium acts to strengthen the alloy, while the iron and manganese tend to harden the alloy, decrease its thermal expansion, increase its machinability, aid in maintaining the mechanical properties of the alloy at elevated temperatures, and increase soldering resistance in die cast applications.

The copper content is maintained below 0.37% and preferably at a minimum. By eliminating any substantial copper concentration, the corrosion resistance of the alloy to salt water environments is greatly improved, making the alloy particularly useful for engine blocks for marine engines and other parts requiring strength, wear resistance and corrosion resistance. The alloy has a weight loss of less than 1% when exposed for 200 hours to a 5% solution of sodium chloride.

The alloy can also contain small amounts, up to 0.2% each, of residual hardening elements such as nickel, chromium, zinc or titanium.

The alloy has excellent wear resistance, and at the stated silicon content, excellent fluidity is achieved.

As the copper content is minimized, the aluminum-silicon-copper eutectic is correspondingly eliminated with the result that the alloy has a relatively narrow solidification range, less than 150° F., and preferably below 100° F.

These properties of good fluidity and a narrow solidification range, provide the alloy with improved castability over known hypereutectic ternary aluminum silicon casting alloys.

In addition, the alloy has a a yield strength of 15,000 to 30,000 psi, an ultimate tensile strength in the range of 20,000 to 35,000 psi, and an elongation of 0% to 2%.

On cooling from solution the silicon precipitates as relatively large crystals. However, in casting cylinder blocks using metal cores a zone is formed bordering each bore that is substantially depleted of silicon crystals due to the rapid dissipation of heat to the metal core. With normal slow cooling this depleted zone generally has a thickness of about 0.02 inch, while under faster cooling conditions the depleted zone can have a thickness up to 0.05 inch. Due to the lack of silicon crystals the depleted zone has reduced wear resistance. It has been the practice in the past to remove the depleted zone by substantial machining, in order to expose the silicon crystals on the surface of the bore.

However, it has been found that when casting engine blocks with the alloy of the invention, the depleted zone can be eliminated by using a dry sand or salt core, which retards the transfer of heat from the molten alloy, and by cooling the casting at a relatively slow rate. with this procedure, the silicon crystals will extend to the surface of the bore and no heavy machining operation is required, thereby substantially reducing the cost of producing the engine block.

The following are specific examples of the alloy of the invention along with the mechanical properties.

EXAMPLE I

Alloy Chemical (weight %):
Silicon: 16.90
Iron: 0.92
Copper: 0.14
Manganese: 0.12
Magnesium: 0.41
Aluminum: 81.51
Solidification Range: 79° F.
Corrosion weight loss (200 hours in 5% NaCl solution): 0.18%
Ultimate tensile strength: 31,157 psi
Yield Strength: 31,157 psi
% elongation: 0.

EXAMPLE II

Alloy Chemistry (weight %):
Silicon: 16.80
Iron: 1.03
Copper: 0.33
Manganese: 0.18
Magnesium: 0.50
Aluminum: 81.16
Solidification Range: 86° F.
Corrosion weight loss (200 hours in 5% NaCl solution): 0.49%
Ultimate tensile strength: 29,164 psi
Yield strength: 29,164 psi
% elongation: 0.

Various modes of carrying out the invention are contemplated as being within the scope of the following claims particularly pointing out and distinctly claiming the subject matter which is regarded as the invention.

We claim:

1. A component for an internal combustion engine, comprising a casting composed of a hypereutectic aluminum silicon alloy, said alloy consisting essentially of 16% to 19% by weight of silicon, 0.4% to 0.7% by weight of magnesium, up to 1.4% by weight of iron, up to 0.3% by weight of manganese, up to 0.37% by weight of copper, and the balance aluminum, said alloy having excellent fluidity, and a solidification range of less than 150° F.

2. The component of claim 1, wherein said component has a weight loss of less than 1.0% when exposed for 200 hours at ambient temperature in a 5% sodium chloride solution.

3. The component of claim 1, wherein said casting is an engine block having a least one cylinder bore therein.

4. The component of claim 3, wherein said block as cast contains precipitated silicon crystals that are uniformly distributed throughout the block including the region bordering each of said cylinder bores.

5. The component of claim 1, wherein said alloy has an ultimate tensile strength of 20,000 to 35,000 psi, a yield strength of 15,000 to 30,000 psi and percent elongation of 0% to 2%.

6. A method of casting an engine block, comprising the steps of forming a mold having a plurality of nonmetallic cores constructed and arranged to form cylinder bores in the cast engine block, preparing a hypereutectic aluminum-silicon alloy consisting essentially by weight of 16% to 19% of silicon, 0.4% to 0.7% of magnesium, up to 1.4% iron, up to 0.3% of manganese, up to 0.37% copper, and the balance aluminum, a solidification range of less than 150° F., casting said alloy into the mold and into contact with said cores, and cooling the cast alloy to produce a solidified cast engine block having precipitated silicon crystals substantially uniformly distributed throughout said cast block.

7. The method of claim 6, wherein said alloy has a weight loss of less than 1% when exposed for 200 hours at ambient temperature in a 5% sodium chloride solution.

* * * * *